United States Patent [19]

Weaver

[11] Patent Number: 4,605,245

[45] Date of Patent: Aug. 12, 1986

[54] SELF-ADJUSTING BOOK COVER

[76] Inventor: Leonard B. Weaver, 4325 S. Bruce St., Apartment #78, Las Vegas, Nev. 89109

[21] Appl. No.: 613,075

[22] Filed: May 22, 1984

[51] Int. Cl.[4] ..... B42D 3/00; B42D 3/02; B42D 3/04; B42D 3/18

[52] U.S. Cl. ..... 281/34; 281/4; 281/16; 281/17; 281/19 R; 281/31

[58] Field of Search ..... 281/4, 16, 17, 29, 31, 281/34, 19 R, 19 A

[56] References Cited

U.S. PATENT DOCUMENTS

| | | | |
|---|---|---|---|
| 1,696,629 | 12/1928 | Fenno | 281/34 |
| 1,895,018 | 1/1933 | Wolf | 281/34 X |
| 1,913,818 | 6/1933 | Petrick | 281/16 |
| 2,422,235 | 6/1947 | Greene | 281/31 X |
| 3,572,767 | 3/1971 | Learned et al. | 281/34 |
| 3,758,136 | 9/1973 | Guyer | 281/31 |

FOREIGN PATENT DOCUMENTS

| | | | |
|---|---|---|---|
| 105230 | 1/1927 | Austria | 281/34 |
| 551591 | 10/1956 | Belgium | 281/16 |
| 807264 | 1/1937 | France | 281/34 |
| 1048232 | 1/1954 | France | 281/16 |
| 1326572 | 4/1963 | France | 281/16 |
| 404445 | 1/1934 | United Kingdom | 281/34 |

*Primary Examiner*—Robert L. Spruill
*Assistant Examiner*—Taylor J. Ross
*Attorney, Agent, or Firm*—Seiler, Quirk & Tratos

[57] ABSTRACT

A flexible, transparent plastic book cover has a pocket portion attached to the front cover portion containing various pages or a booklet containing emergency medical information. The book cover is particularly adapted to fit telephone directories of any thickness. The book cover has a front cover section having a pocket to slide over the front cover of a phone book, and a rear cover section having a sleeve for slidably receiving the back cover of a phone directory. The third section, which is hingedly attached to a forward portion of the front cover section and extends rearwardly therefrom, is adapted to mount a booklet containing medical information.

4 Claims, 4 Drawing Figures

SELF-ADJUSTING BOOK COVER

BACKGROUND OF THE INVENTION

This invention relates to protective covers for books, especially telephone books. More particularly, the invention is directed to a telephone book cover having a flexible, protective sheath which wraps around the exterior of the book, and which also has an attached section adapted to receive and enclose one or more sheets or placards. A particularly important feature of the invention is a sleeve through which the rear cover of a telephone book may extend, thereby providing automatic fitting of the cover to phone books of various thicknesses.

Various types of protective covers formed from paper, leather, or plastic have been used to cover and protect books. Depending on the particular use, these covers may be made from opaque material, so as to provide a decorative covering as well as to obscure the identity of the book, or may be of transparent material enabling visual identification of the book when the cover is in place. Generally, the covers comprise a jacket which extends around the exterior periphery of the book, and contain interior pockets into which the front and back covers of the book may be inserted to secure the jacket to the book. In general, these covers have suffered from the disadvantage that they are not easily adaptable to different book thicknesses; i.e., jackets of different sizes must be available to cover different thicknesses of books. This is a particular problem with telephone books, which have pages which are typically 9" wide by 13" high, but which may contain anywhere from less than 100 to more than 1,000 pages. One effort to provide an adjustable cover to adapt to books of various thicknesses is shown in Learned et al, U.S. Pat. No. 3,572,767. In this device, the spine portion of the cover has a variable width.

It is important for every household to maintain certain emergency information in a readily accessible, easily remembered location. In general, in virtually every household emergency, it is necessary to place a telephone call to obtain emergency assistance. This call may commonly be placed to a local fire department, police department, hospital, doctor, or even to a neighbor. In recognizing the probability that the telephone will be used to obtain emergency assistance, most telephone companies place certain emergency numbers on or inside the telephone book cover. Accordingly, most homeowners are conditioned to go to the telephone book in an emergency situation. In many emergency situations however, some action must be taken prior to the time that skilled emergency assistance arrives. The ability of a person to provide certain basic lifesaving techniques (e.g., cardiopulmonary resuscitation, relief from choking, cessation of bleeding, emergency childbirth, treatment of drug overdose, and the like) may indeed be the difference between death and survival. While many people have at least limited knowledge of various lifesaving techniques, because they are practiced infrequently most persons do not have adequate recall of even basic emergency techniques. Because of the propensity of a person to associate the telephone with an emergency, the invention provides a method of conveniently attaching information relating to emergency medical techniques to a conventional telephone directory.

The invention provides a jacket for a telephone book or the like which extends substantially around the peripheral covers of the book, and which adjusts to various book thicknesses by having the portion thereof which covers the back telephone book cover comprise a sleeve through which the book cover extends, the width of the sleeve being generally less than the width of the cover. The jacket contains a connected section which is hingedly attached to a forward portion of the front panel of the jacket, and which is adapted to secure a booklet or a series of information-containing pages to the jacket. Accordingly, it is an object of the present invention to provide a telephone book cover which automatically adjusts to books of various thicknesses. It is another object of the invention to provide a telephone book jacket having means to carry pages of emergency life saving information. It is yet another object of the invention to provide a combination of a telephone book and emergency first aid booklet, and a jacket for protectively enclosing both items. These and other objects of the invention will be clear from the following detailed description of preferred embodiment thereof.

BRIEF SUMMARY OF THE INVENTION

A book jacket designed to protectively enclose a telephone book and to removably secure additional information carrying pages comprises a first section having a sleeve portion formed from inside and outside panels adapted to slidingly receive the rear cover of a telephone book, a second section having a pocket adapted to slidingly receive the front cover of a telephone book, and a third section extending rearwardly from the second section having at least one pocket formed by flat rectangular panels having three sealed edges. The third section is hingedly attached to a forward portion of the second section, and is adapted to extend rearwardly and lie flat over the top of the second section.

BRIEF DESCRIPTION OF THE DRAWINGS

The invention is best understood with reference to the drawings, in which.

DETAILED DESCRIPTION OF A PREFERRED EMBODIMENT

Figure 1:
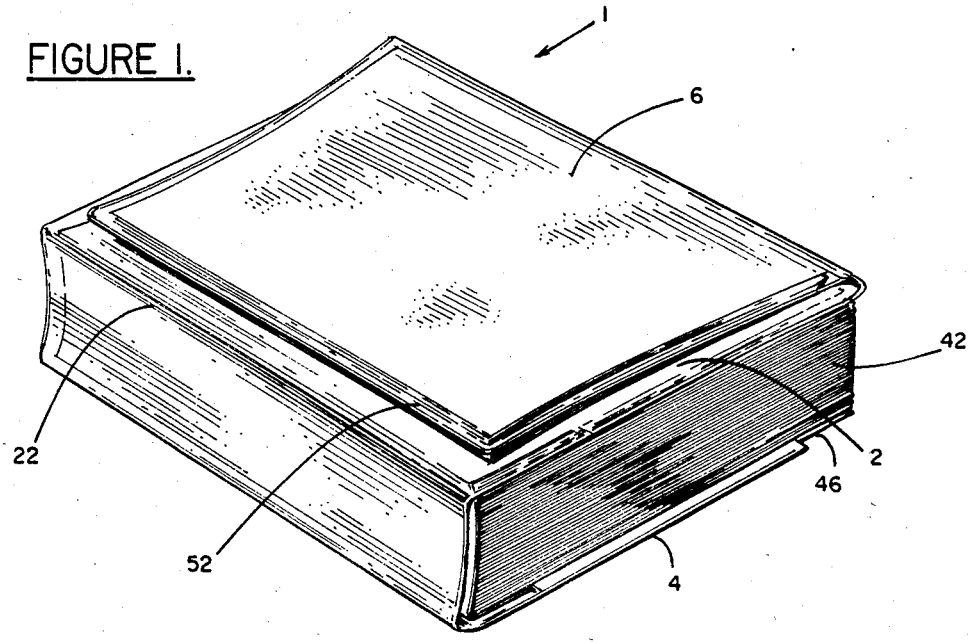
FIG. 1 is a perspective view of a book cover in accordance with the invention in place over a telephone book, with an emergency life saving booklet in place in said cover.
Figure 2:
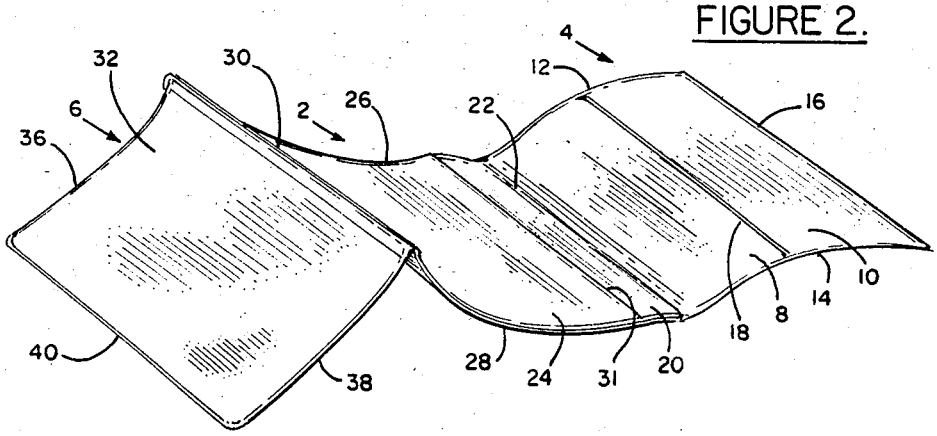
FIG. 2 is a perspective view of the book cover alone in extended form.
Figure 3:
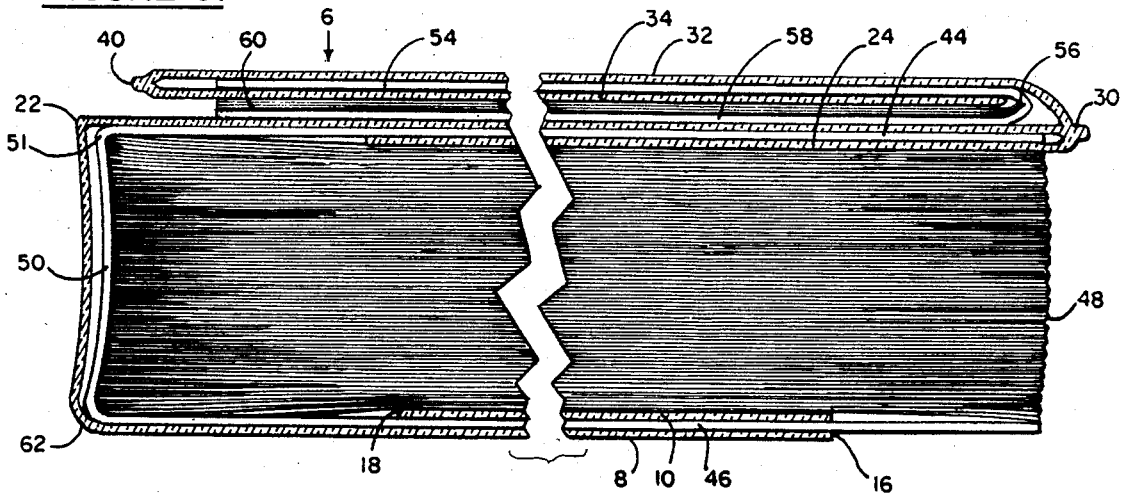
FIG. 3 is a side elevational section of a book cover of the invention in place on a telephone book.

A preferred embodiment of a jacket cover according to the invention is shown in FIGS. 1–3. For convenience, the jacket of the invention will be referenced herein according to the position in which it fits on the phone book; therefore, the "top" and "bottom" of the device will refer to the upper and lower edges, the terms "front" and "back" as well as the terms "inside" and "outside" refer to the portions of the jacket as it is mounted in place on a telephone book. These terms are used for reference only and are not to be construed as limiting the scope of the invention.

Referring first to FIG. 1, book cover or jacket 1 is shown mounted on phone directory 42. The jacket is made from a flexible, transparent thermoplastic material, with the various plies thereof being secured at the edges by heat sealing. The jacket generally comprises three sections; a first section 2 containing an interior pocket to receive the front cover of the telephone directory, a second section 4 comprising a sleeve through which the back cover of the directory extends, and a third section 6 which lies flat across the front of the telephone directory and which contains a booklet, pamphlet, or various sheets or placards which carry emergency medical information.

As is best seen in FIGS. 2 and 3, the rear section 4 of the jacket of the invention comprises an exterior flat panel 8 and an interior adjacent panel 10 which are heat sealed along common edges 12 and 14, but which are open along edges 16 and 18, thereby forming a flat sleeve adapted to slidingly engage the back cover 46 (see FIG. 3) of a phone directory. Depending on the thickness of the directory, the front edge of the directory will extend through the sleeve to varying distances. The back section 4, when in place on the directory, covers at least a portion of the back page of the phone directory and also covers the spine portion 50, as is shown in FIG. 3. The front and back sections are approximately equal in length; although the back section must also cover the spine of the book as well as the back cover, depending on the book thickness it may not extend all the way across the back cover of the book.

A crimped edge 22 separates the front section 2 from the back section 4 of the jacket. The crimped edge is adapted to align with the rear edge 51 of the directory. As best seen in FIG. 3, the remainder of the exterior back panel 8 of the jacket, because of its flexibility, simply adapts to the shape and thickness of the phone directory. Therefore, while the front edge 22 is crimped and is always adjacent to the front edge of the directory spine, the rounded rear corner 62 of the jacket will simply form along rear panel 8 at a location depending upon the thickness of the telephone directory. Regardless of the directory thickness, the jacket will fit smoothly along the exterior surface of the directory because an adjustment is always made by the rear cover of the phone book extending through the sleeve in the rear panel of the jacket.

The front section 2 of the jacket consists of an outside panel 20 (which is simply an extension of rear panel 8), and an adjacent inside ply 24. The inside and outside panels 24 and 20, respectively, are sealed together along their common upper edge 26, lower edge 28, and forward edge 30. The inside and outside panels form a pocket along the non-sealed edge 31 of the inside pocket, thereby permitting insertion of the front cover of the phone book slidably between the panels.

In the embodiment shown in FIGS. 1–3, the third section 6 of the jacket is hingedly attached along heat-sealed edge 30, and extends rearwardly across the front cover portion of the jacket. The third section lies flat across the top of the phone book. This section consists of an outside or front panel 32 and an inside panel 34 which are heat sealed together along common upper edge 36, lower edge 38, and rear edge 40. These panels form a rearwardly extending pocket into which the front cover 54 of information booklet 52 is inserted.

The manner in which the telephone book and information book are mounted in the jacket is best seen in FIG. 3. Phone book 42 has a front cover 44 which extends forwardly into a pocket formed from interior panel 24 and exterior panel 20 of the front jacket section 2. A crimped edge 22 aligns with the rear edge 51 of the front cover of the phone book. The back cover 46 of the phone directory extends through the sleeve formed by interior panel 10 and exterior panel 8 of section 4 of the jacket. The distance to which the rear cover extends through the sleeve is determined by the number of pages 48 of the directory; for directories containing a small number of pages, the rear cover would extend farther through the sleeve because more of the length of rear panel 8 would extend along the spine portion of the directory. The booklet 52 containing emergency information has a top or front cover 54 which is mounted in the pocket formed in the third section 6 of the jacket. The information booklet is printed so as to open backward, i.e. the pages 60 open from left to right. The back cover 58 of the booklet rests on the front panel 20 of the jacket.

The information booklet held in the front portion of the jacket generally contains a brief description of procedures to follow in various medical and other emergencies. Because the front panel 32 of the jacket is transparent, the information printed on the outside cover 54 of the booklet is visible through the jacket and should preferably list a table of contents for the booklet. The table of contents should index the various emergncy problems briefly by subject matter, such as "Heart Attack", "Choking", "Bleeding", "Drug Overdose", "Poisons", etc. In an emergency, a person can then proceed quickly to the telephone directory, find the emergency treatment information which relates to the specific problem being incurred, and refer directly to a brief instruction as to how to handle the problem.

Figure 4:
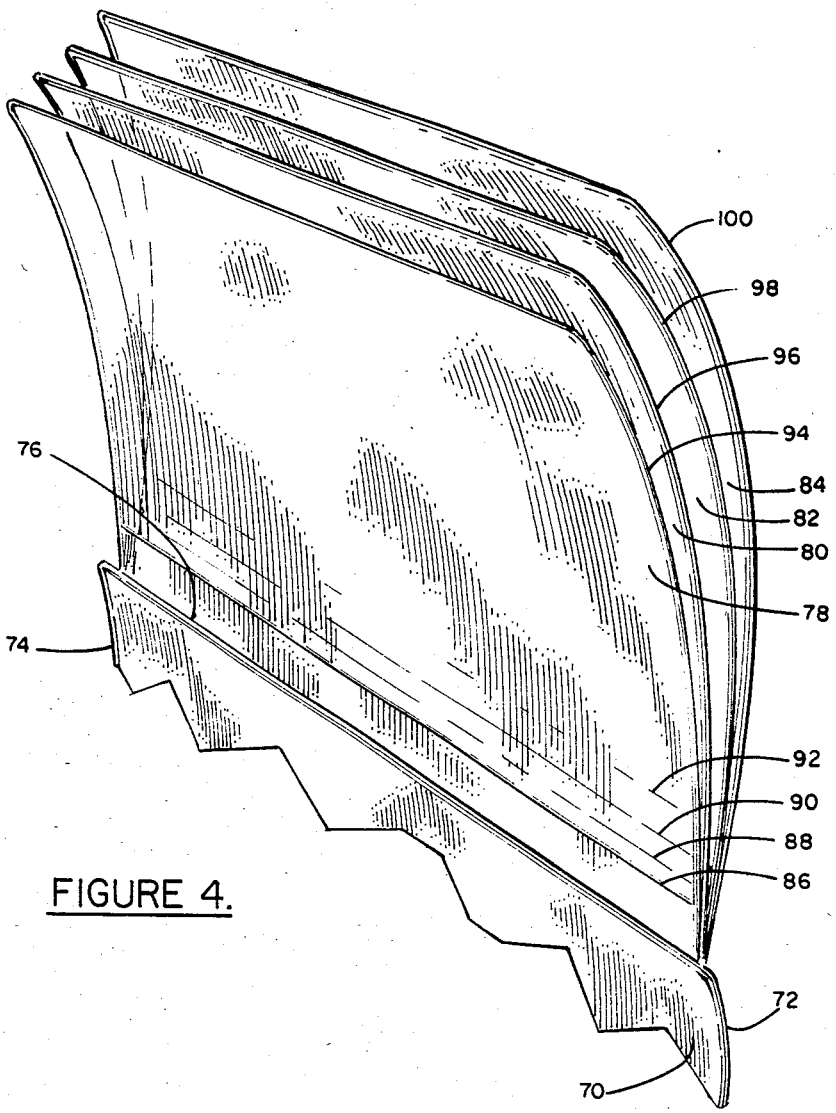
FIG. 4 is a partial perspective view of another embodiment of the invention having a plurality of pockets for receiving additional pages of information.

An alternate embodiment of the jacket of the invention is shown in FIG. 4. Instead of having a single pocket at the front portion of the jacket which is adapted to receive only the cover of an emergency booklet, this embodiment has a plurality of pockets hingedly attached to the forward portion of the directory cover jacket for the purpose of holding and displaying several pages of emergency information. As shown in FIG. 4, the interior panel 70 of the pocket holding the top phone directory cover has upper edge 72, lower edge 74, and rear edge 76 which are the heat sealed edges forming the pocket periphery. Pocket members 78, 80, 82, and 84, formed from two plies of transparent thermoplastic material and heat-sealed around three peripheral edges similarly to the pockets shown in FIGS. 1–3, extend outwardly from edge 76 of the jacket. The pockets have openings 86, 88, 90, and 92 formed by the non-sealed edge of the interior panel. These pockets are generally used to receive individual sheets of stiff or heavy paper on which emergency information or other relevant information is printed. Each sheet is therefor individually protected in its own pocket. In order to provide easy visibility and indexing, the widths of pockets 78, 80, 82, and 84 are progressively greater (i.e., 94, 96, 98, and 100 are progressively longer) to provide a layered effect of the pockets as they rest on the front cover of the directory.

While the book jacket of the invention is primarily intended for use with phone directories, and for the purpose of providing a convenient vehicle for displaying medical information, the jacket is not limited to this use. For example, it could be used by hotels to carry and display information about hotel facilities, such as recreational facilities, entertainment, and room service. Additionally, the jacket may be used on books other than telephone directories.

While the jacket of the invention may be used to provide an opaque, decorative cover for a phone book, it is preferred that at least the top panel which displays the emergency medical information booklet be transparent to continually remind the homeowner that the emergency information is present in this location. The jackets of the invention are easily fabricated by conventional technology from readily available thermoplastic materials, such as polyvinyl chloride, polyethylene, polystyrene, or any similar synthetic resin. Accordingly, a number of variations may be made to the jacket of the invention within the spirit and scope of the invention; therefore, the invention should not be considered limited by means of the foregoing descriptions of specific embodiments thereof but should rather be limited only by the following claims.

I claim:

1. In combination, a telephone book cover adapted to extend around the exterior of a telephone book comprising a first section having an open-ended sleeve formed from inside and outside panels and adapted to slidingly receive the back cover of a telephone book, a second section having a pocket adapted to slidingly receive the front cover of a telephone book, and a third section extending rearwardly from the second section having at least one pocket formed by flat rectangular panels having three sealed edges, and a plurality of pages bound into a book having front and rear covers, wherein a cover of the book is slidably mounted into the pocket in the third section.

2. The combination of claim 1 wherein the front cover of the book is mounted in the pocket.

3. In combination, a telephone book having front and back cover pages, a book cover mounted on the telephone book extending around the exterior of the book comprising a first section having an open-ended sleeve formed from inside and outside panels and adapted to slidingly receive the back cover of the book, a second section having a pocket adapted to slidingly receive the front cover of the book, and a third section extending rearwardly from the second section having at least one pocket formed by flat rectangular panels having three sealed edges, and a plurality of pages bound into a second book having front and rear covers, wherein a cover of the second book is slidably mounted into the pocket of the third section.

4. The combination of claim 3 wherein the front cover of the second book is mounted in the pocket.

* * * * *